United States Patent [19]

Dumortier

[11] 4,364,689

[45] Dec. 21, 1982

[54] MANHOLE COVER ASSEMBLY

[76] Inventor: Robert Dumortier, 9 rue Duchartre, Beziers, France

[21] Appl. No.: 256,922

[22] Filed: Apr. 23, 1981

[30] Foreign Application Priority Data

Apr. 25, 1980 [FR] France ..... 80 09720
Nov. 24, 1980 [FR] France ..... 80 25029

[51] Int. Cl.[3] ..... E02D 29/14

[52] U.S. Cl. ..... 404/25; 210/164; 52/20; 49/394; 292/300; 292/57; 403/353; 404/4

[58] Field of Search ..... 49/381, 394, 465, 463; 404/25, 26, 4; 52/19, 20, 21; 210/163, 164; 292/300, 57; 403/353; 16/124, 115

[56] References Cited

U.S. PATENT DOCUMENTS

| | | | |
|---|---|---|---|
| 1,016,081 | 1/1912 | McNulty | 49/465 |
| 1,165,804 | 12/1915 | Quigley | 49/465 |
| 1,375,222 | 4/1921 | Lutz | 210/163 |
| 1,877,996 | 9/1932 | Shanley | 49/465 |
| 1,962,881 | 6/1934 | Shanley | 49/465 |
| 1,988,360 | 1/1935 | Moore | 49/465 |
| 3,977,124 | 8/1976 | Oger | 49/465 X |
| 4,175,781 | 11/1979 | Dumortier | 49/465 X |

FOREIGN PATENT DOCUMENTS

| | | | |
|---|---|---|---|
| 645918 | 7/1964 | Belgium | 49/394 |
| 2501434 | 11/1975 | Fed. Rep. of Germany | 404/25 |
| 7424255 | 2/1976 | France | 404/25 |
| 2424372 | 12/1979 | France | 49/465 |
| 2457932 | 12/1980 | France | 52/19 |
| 25746 | of 1912 | United Kingdom | 49/463 |

*Primary Examiner*—Nile C. Byers, Jr.
*Attorney, Agent, or Firm*—Karl F. Ross

[57] ABSTRACT

A manhole cover assembly comprises a seating ring which can be inset in a street or roadway surface and which is formed with a pair of lateral compartments in which respective latches of the plug-like cover can be received. According to the invention, the cover has a pair of opposing radial projections adapted to be received under respective projections of the ring upon rotation of the cover relative to the ring in bayonet action. Each of the latches is in the form of a pawl pivotal about a respective pin on the radial projection and adapted to swing so that a surface of the pawl substantially completely closes the compartment, flush with the upper surface of the ring and an end wall of the pawl abuts or is juxtaposed with the wall of the compartment to prevent rotation of the cover. The pawl can have flanges which, when the pawls are swung upwardly, form handles enabling the cover to be lifted from the ring.

9 Claims, 16 Drawing Figures

FIG. 1
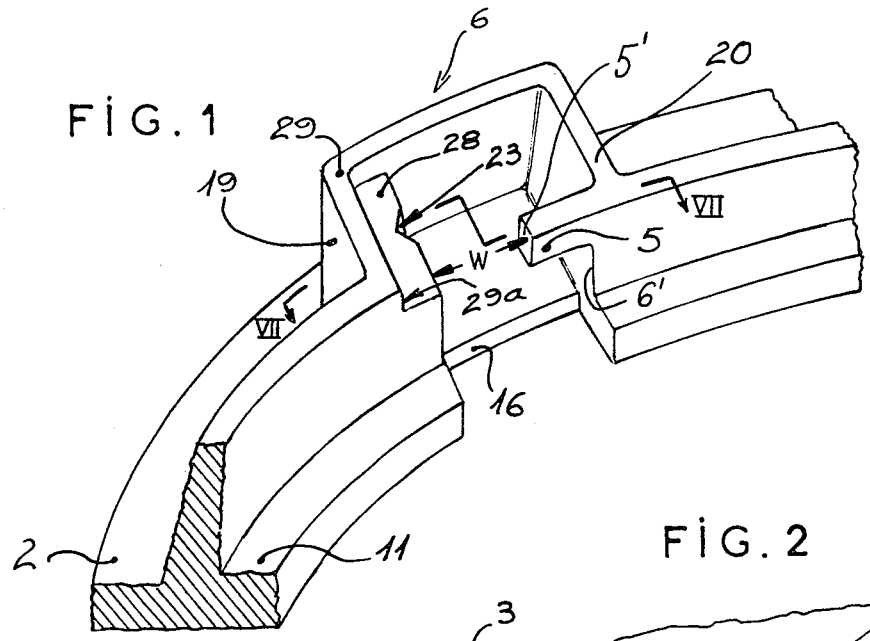
FIG. 2
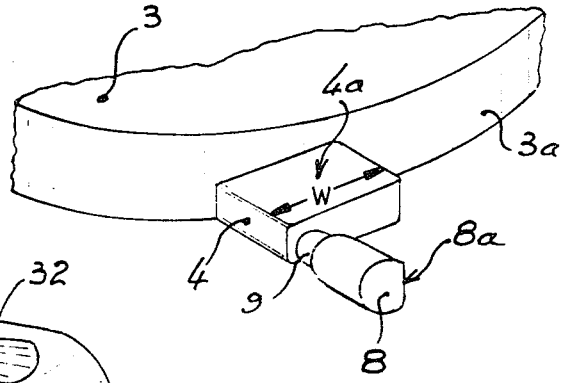
FIG. 3
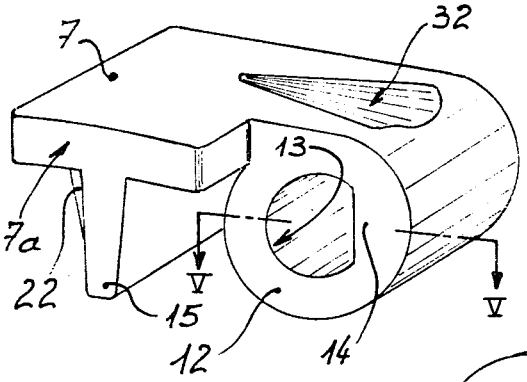
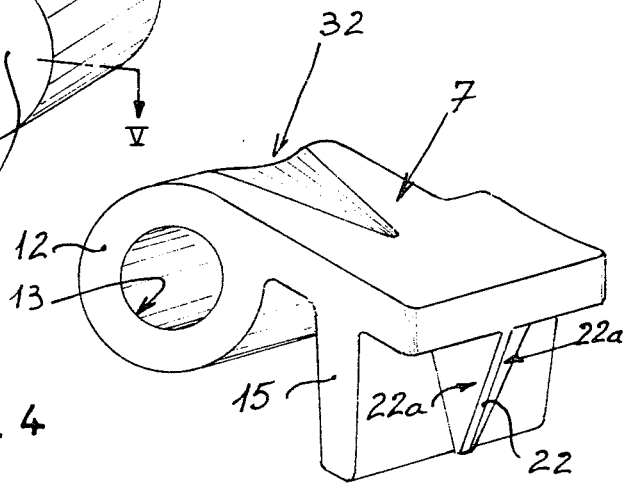
FIG. 4

FIG. 14
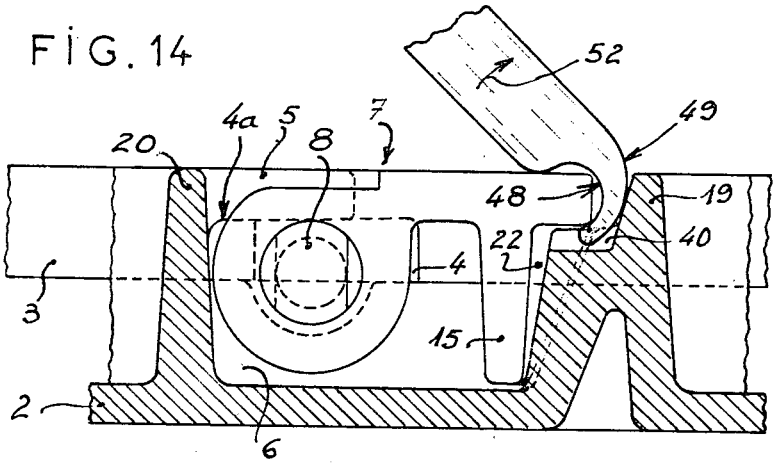
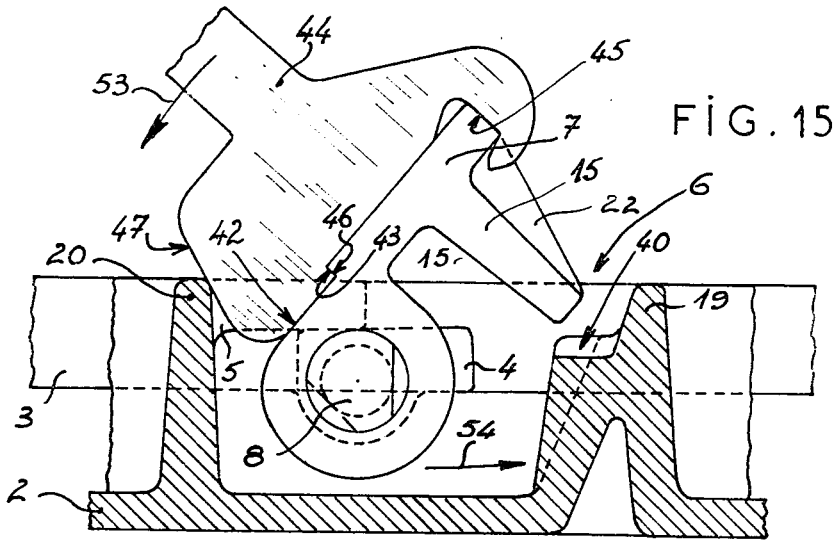
FIG. 15
FIG. 16
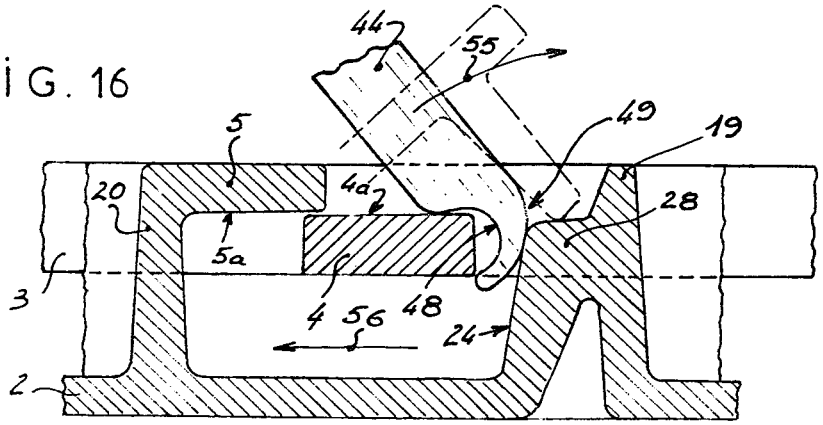

MANHOLE COVER ASSEMBLY

FIELD OF THE INVENTION

My present invention relates to a manhole cover assembly, and, more particularly, to an assembly of the type which comprises a ring adapted to be set in a roadway surface around a manhole opening, a plug-type cover adapted to be received in this ring, and means for locking the cover relative to the ring to prevent inadvertent removal or dislocation of the cover.

BACKGROUND OF THE INVENTION

It is known to provide manhole cover assemblies which comprise fixed rings which can be set in a roadway surface to surround a manhole opening and plug-type covers which are adapted to rest upon inwardly extending flanges of this ring and be connected thereto by a bayonet-type connection whereby projections from the cover engage beneath projections on the ring upon rotation of the cover in one sense. When the cover is rotated in the opposite sense, the radial projections of the cover clear the generally tangential projections of the ring and enable lifting of the cover.

Problems have been encountered with such assemblies because of the inadvertent release of the cover by the ring and as a result of passage of traffic over the assembly. In addition, there has been a tendency for the radial projections of the cover to be broken off upon repeated removal and replacement of the cover and/or as a result of the passage of heavy vehicles thereover. Since the covers are particularly heavy, because they are generally composed of malleable cast iron or spheroidal graphite cast iron, this tendency is pronounced and replacement of the projections is difficult if not impossible.

Another disadvantage of conventional bayonet-locking arrangements is that the personnel responsible for replacing the cover frequency forget to lock the same in place. As a result, vibration imparted to the cover by the passing traffic tends to induce pivoting of the cover and the release thereof with the ensuing danger to the vehicles and passers-by.

It is known to provide supplementary locking arrangements which are intended to avoid inadvertent opening of the bayonet connection, e.g. by requiring the operation of a key which is rotatable about a vertical axis and which carries a plate closing the chamber through which the key passes and which can be formed as an eye on the ring.

This key can be mislaid in handling of the cover so that, when the cover is replaced, it cannot be locked.

Other problems are also encountered with such existing structures, namely, that of lifting the cover conveniently, preventing loss of the key and ensuring that locking will be effected after replacement of the cover in the ring following its removal.

OBJECTS OF THE INVENTION

It is the principal object of the present invention to provide an improved manhole cover assembly whereby the aforementioned disadvantages and others characterizing the earlier systems, can be obviated.

Another object of the invention is to provide, in a manhole cover assembly of the type described, a locking device which cannot be lost and which effectively prevents release or unlocking of the manhole by accident or through inadvertence.

Yet another object of the invention is to provide an improved locking system for manhole covers.

SUMMARY OF THE INVENTION

These objects and others which will become apparent hereinafter are attained, in accordance with the present invention, in a manhole cover assembly which comprises a ring adapted to be set into the pavement of a roadway and to surround a manhole opening, a plug-type cover receivable in this ring and connectable by a bayonet connection therewith, so that the manhole cover is locked in place by rotation relative to the ring in one sense, and means nonreleasable from the formation of the cover forming the bayonet connections, for blocking rotation of the cover in the opposite sense.

According to the invention, the ring is formed with an inwardly extending shoulder, seat or flange upon which the cover is adapted to rest and with a pair of lateral chambers opening inwardly at respective windows which are overhung by projections of the ring to form the members or formations beneath which radial projections or formations on the cover can engage.

The latching or blocking means can then include respective pawls swingable on pins extending from these projections and securely held on these pins to prevent withdrawal of the pawls from the pins at least in most operative positions of the pawl.

According to the invention, each pawl, in its blocking position, confronts a wall of the respective chamber or eye of the ring and is positioned preferably to engage this wall and thereby block the rotation of the cover in the opening sense unless the pawl is swung upwardly.

The pawls are thus anchored laterally to the cover and can have two main operating positions, namely the upright or vertical position which enables the cover to be rotated in the opening sense and a horizontal or blocking position which immobilizes the respective pin in the chamber and hence prevents rotation of the cover in the opening sense. This locking means thus prevents inadvertent lifting of the cover. The pawl can be a plate having an upper surface which is flush with the top of the ring and the chamber in the horizontal position of the pawl so that vehicles traveling along the roadway tend to maintain the pawl depressed and in the horizontal position thereby contributing to the locking of the cover.

When there is a danger that sand, dirt, earth or like contaminants may penetrate into the region of the pawl and interfere with opening or lifting thereof, it is advantageous to utilize a special tool according to the invention.

I have found it to be advantageous to form at least the edge of the chamber or eye receiving the pawl, in the region of the wall of the chamber juxtaposed with the free end of the pawl, with a notch or gap defining with the lower face of the free end of the pawl a passage enabling insertion of a hook at one end of an opening tool which is provided at this end with an edge resting against the upper face of the pawl. The latter can also include a notch or recess in which the tool can be set for proper alignment at the tool having a cammed surface adapted to engage the opposite edge of the chamber to cam the rear end of the pawl in the direction of the notched chamber wall thereby shifting the cover within the ring to disengage the bayonet connection while pivoting the pawl upwardly into its open position. The latter recess can also receive a pick facilitating removal of the cover.

The opposite end of the tool can likewise be formed with a hook enabling the pawl to be initially pried upwardly.

While the tool facilitates opening of the pawl to disengage the cover from the ring even when contaminants may be present, the combination of the pawl and the tool serves to constitute a system for displacing the cover angularly as well and thus forms part of the manhole cover assembly at least during opening of the cover.

BRIEF DESCRIPTION OF THE DRAWING

The above and other objects, features and advantages of the present invention will become more readily apparent from the brief description reference being made to the accompanying drawing in which:

FIG. 1 is a partial perspective view in the region of an eye or compartment of the stationed bayonet formation illustrating a ring adapted to be seated in the pavement of a roadway and surround a manhole opening;

FIG. 2 is a fragmentary perspective view of a radial projection adapted to form the movable member of the bayonet assembly and on a plug-type cover adapted to be received in the ring of FIG. 1, another such radial projection being provided at a diametrically opposite side of the cover for cooperation with another compartment or eye of the ring;

FIG. 3 is a perspective view from one side of the blocking pawl adapted to pivot on the pin of FIG. 2;

FIG. 4 is a perspective view of this pawl from the opposite side;

FIGS. 14 through 16 are fragmentary cross sectional views showing the use of the tool of FIG. 13 in various phases of the opening and closing of the cover assembly according to this invention.

SPECIFIC DESCRIPTION

Figure 5:
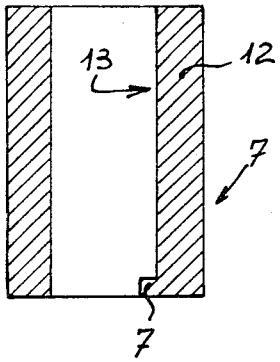
FIG. 5 is a cross sectional view taken along the line V—V of FIG. 3.

The manhole cover assembly shown in the drawing comprises a ring 2 which constitutes a seat for a cover 3 directly or via an annular ceiling member such as an O-ring, gasket or the like. The cover 3 is of the plug type, i.e. is received within the ring and rests upon a flange 11 thereof (FIG. 1).

The ring is formed with at least one and preferably two chambers or eyes 6 while the cover is formed with a corresponding number of radial projections or fingers 4. Each of these projections 4, shown to be prismatic and of generally rectangular profile, is adapted to cooperate with a projection or beak 5 of the ring in a bayonet joint.

More particularly, a window 6' opens laterally into the chamber 6 and is overhung by the beak 5 which, in turn, defines a gap 5' of a width W which is approximately equal to the width w of the finger 4.

Thus, when the cover is dropped into place, the finger 4 passes through the gap 5' into the window 6' and below the beak 5 to rest upon the shoulder or flange 11. The cover can then be rotated, in the clockwise sense for the orientation shown in FIG. 1, to swing the finger 4 beneath the beak 5 and thereby retain the cover in the ring by bayonet operation.

According to the invention, the locking device comprises respective pawls 7, one of which has been shown in FIGS. 3 and 4 in views from opposite sides, each pawl being mounted upon a horizontal cylindrical pin 8 which is provided with a flat **8*a* at its extremity remote from the finger 4. The pins 8 have circumferential grooves 9 forming a neck adjacent the locking finger 4**.

Thus each pawl is pivoted about a horizontal axis extending transversely of and constituting an extension of the respective finger 4.

As can be seen from FIG. 3, the pawl 7 is pivotally mounted at one of its ends on the pin 8, this end being formed as a bearing or bushing 12 containing a bore 13 which is cylindrical (see FIG. 5) to the end exposed in FIG. 3 at which this bore is terminated in a crescent-shaped formation 14 visible in FIGS. 3 and 5. This crescent-shaped formation is adapted to fit into the groove 9 to allow the pawl to swing about the axis of pin 8 while preventing the pawl from falling off or being withdrawn from the pin unless the crescent formation 14 is disposed in line with the flat **8*a*** of this bore.

Figure 6:
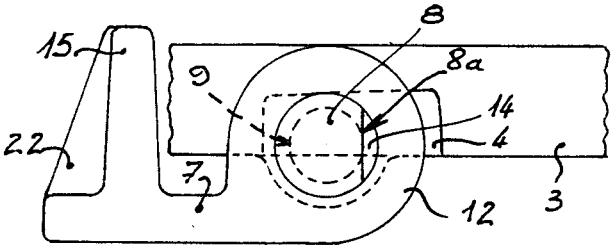
FIG. 6 is a fragmentary side elevational view illustrating the mounting of the pawl on the pin.

When the pawl is thus aligned with the pin (see FIG. 6), a position in which the pawl is swung through an angle of 180° from its normal blocking position, the pawl can easily be slid axially over the pin. When the pawl is then swung into its operating position (FIGS. 7 and 8) disengagement of the pawl from the pin is not possible since the crescent-shaped formation 14 forms a key facilitating rotation but limiting axial displacement.

Because of this relatively simple structure, each pawl is permanently connected to the cover and cannot be dislodged during normal manipulation within or outside the ring 2.

As has been shown in FIGS. 3 and 4, the pawl 7 also comprises, in the region of its other end, a lower transverse flange 15 extending perpendicular to the plate **7*a* of the pawl and downwardly when the pawl is in its horizontal position, this flange being set back slightly from the free end of the plate 7*a***.

When the pawl 7 is swung into its upright position (FIG. 7), the flange 15 lies horizontally and forms a handle enabling the worker to grip the cover and lift the same from the ring 2.

The handle is also operative to enable the cover to be set in place with the finger 7 aligned with the windows in the manner previously described.

When the cover is rotated in the appropriate sense (represented by the arrow 18), the finger 4 swings beneath the beak 5 in the manner previously described (FIG. 7), the beak thereupon overhanging the finger 4.

At this point, the pawl 7 can be pivoted clockwise (arrow 25 in FIG. 7) so that the free end of the pawl is closely juxtaposed with, confronts or contacts the wall 19 of the compartment opposite the wall 20 from which the beak 5 projects. A displacement of the cover in the direction of arrow 21 is thus precluded (see FIG. 8) and accidental unlocking of the cover assembly is barred.

It has been found to be advantageous to facilitate the locking of the cover by providing each of the fingers 4 along its upper surface with a sloping face 4*a* which has generally the configuration of a wedge and is adapted to cooperate with an inclined complementary face 5*a* formed on the underside of the beak 5.

In this embodiment, the pawl 7 is provided, at its free end, with a wedge-shaped portion adapted to cooperate with the correspondingly shaped internal surface of the chamber wall in order to drive the radio-finger 4 beneath the beak 5 when the pawl is depressed.

Figure 7:
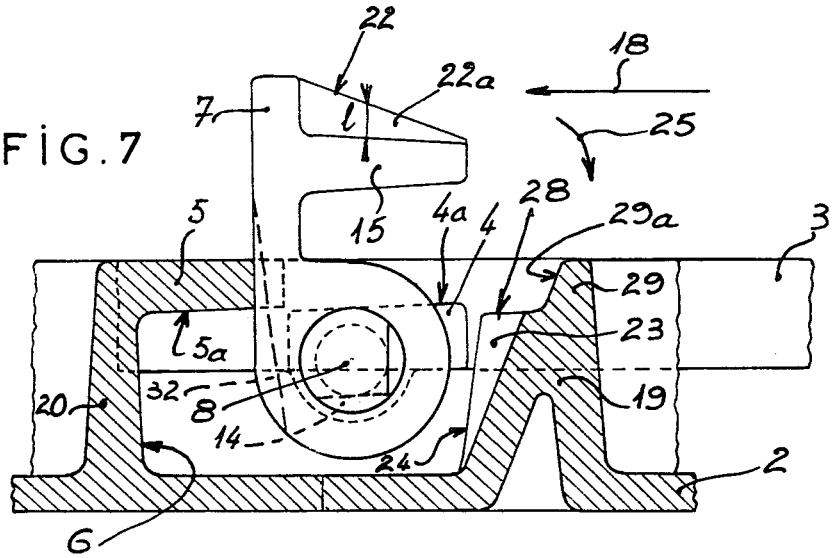
FIG. 7 is a section taken along the line VII—VII of FIG. 1 of a manhole cover assembly with the blocking pawl swung upwardly to enable closure of the cover.
Figure 8:
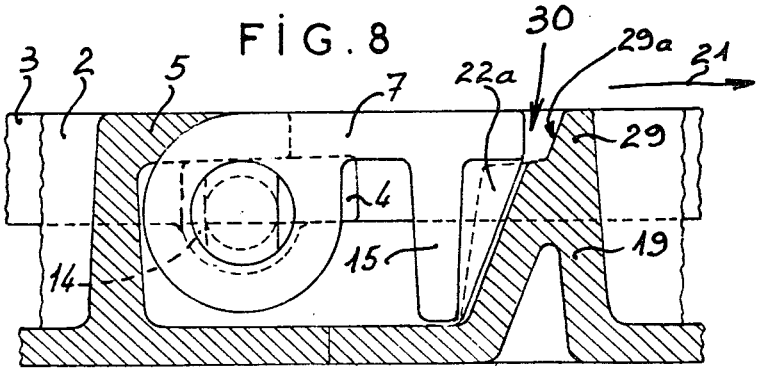
FIG. 8 is a view similar to FIG. 7 showing the pawl in its locking position.
Figure 9:
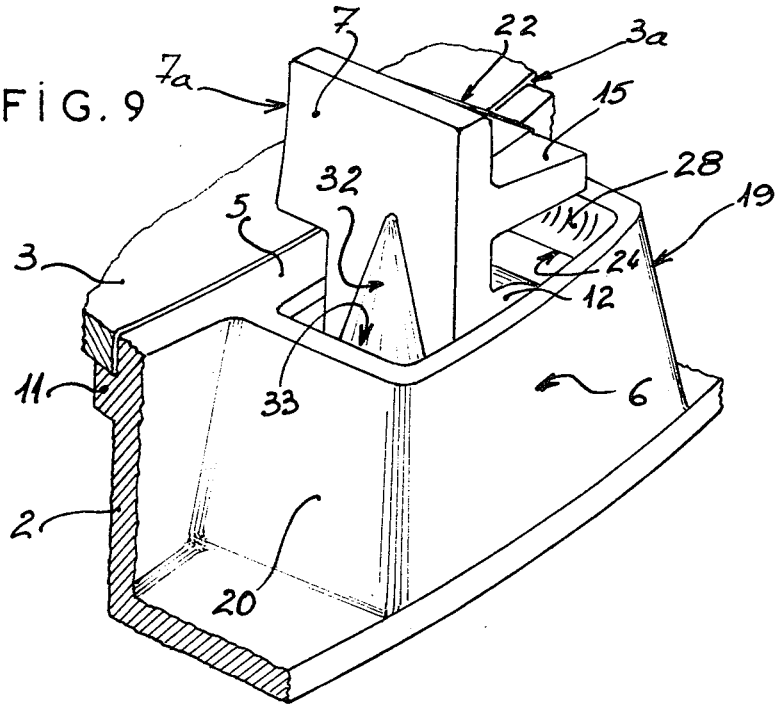
FIG. 9 is a perspective view of a portion of the apparatus showing the pawl in its upright position to enable lifting of the cover from the ring.
Figure 10:
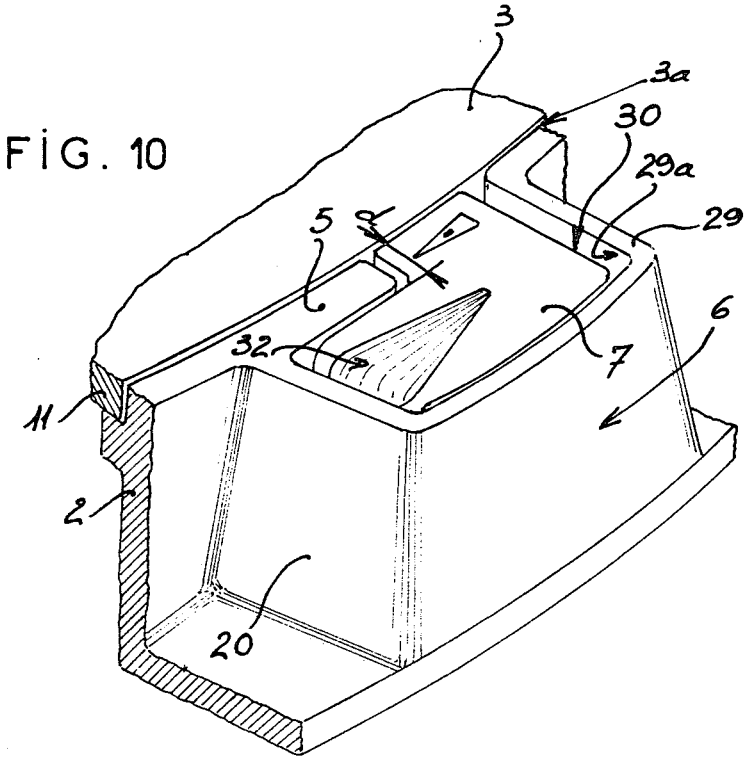
FIG. 10 is a view similar to FIG. 9 showing the pawl in its blocking position.

This will be more readily apparent from FIGS. 7 and 8. In this case, at its free end, the pawl is formed with a rib 22 of wedge shape having sloping lateral surfaces 22*a* (see also FIG. 4) and a width 1 increasing upwardly from the lower end of the flange 15.

This rib cooperates with the surfaces 23 of a groove of complementary dimensions and shape formed in the internal face 24 of wall 19 of the compartment.

When the pawl is thus swung downwardly (arrow 25 in FIG. 7) and the finger 4 is not fully engaged beneath the beak 5, the rib 22 acts as a wedge together with the faces 23 to drive the pivot pin 8 to the left (arrow 18) and properly seat the finger 4 beneath the beak 5.

As has been shown in FIG. 1, the wall 19 of the compartment 6 comprises an abutment seat 28 to receive the free end of the pawl. This seat is extended by a rib 29 constituting an extension of the peripheral of the compartment.

From FIG. 3 it will be apparent that the internal face 29*a* of this rib defines a frame which surrounds the plate 7*a* of the pawl when the latter is closed (FIG. 8) although a gap is provided at the free end of the pawl enabling the insertion of a tool to lift the pawl.

From FIGS. 3, 4, 9 and 10 it will also be apparent that the pawl is provided on its back and upper portion of the bearing or bushing sleeve 12 with a longitudinal groove 32, preferably widening rearwardly, which after the pawl has been lifted by a tool into the vertical position (FIG. 7) defines a vertical passage 33 running along the groove which can receive a spike at the end of the tool, e.g. a conventional pick whose blade can be inserted at 30 (FIG. 10) to lift the pawl thereby constituting of the pick a wedge and enabling the pick to rotate the cover in the direction of the arrow 21 for opening.

In order to prevent penetration of contaminants into the cavity formed by the eye 6, the free end of the pawl 7, i.e. the part thereof carrying the flange 15, is somewhat wider than the part forming the sleeve 12, by the dimension d (FIG. 10) corresponding substantially to the width of the beak 5. Thus the inner lateral face of the pawl, which is concave, is adapted to lie very close to the peripheral surface 3*a* of the cover 3.

The pawl 7 can be fabricated by conventional foundry procedures from the same material as the remainder of the cover and can be mounted at the factory upon the pin 8 without any danger that it will accidently come off the pin. The cover thus is provided directly with handles for lifting the cover and lowering the same as well as with the blocking means.

The embodiment of FIGS. 11 through 16 is generally similar to that of the previous figures except that it utilizes a lever-like tool 44 to operate the pawl 7. This lever is especially advantageous when pulverulent deposits may interfere with displacement of the pawl between its open and closed positions.

Figure 11:
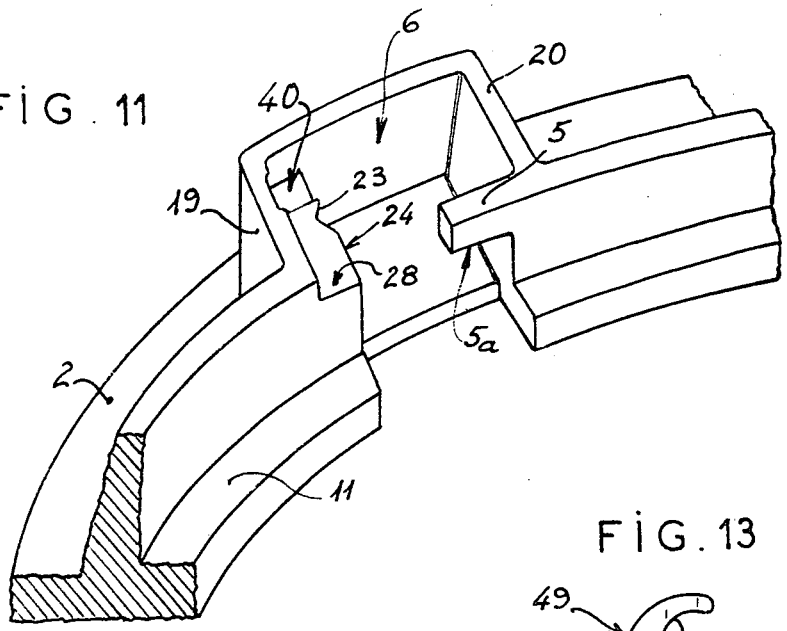
FIG. 11 is a fragmentary perspective view similar to that of FIG. 1 illustrating another embodiment of the eye of the ring according to the invention.

As shown in FIG. 11, the abutment 28 in the eye or compartment 6 is formed along its substantially horizontal face with a step 40 which can constitute a notch and thus provides a clearance below the lower face of the plate 7*a* of the pawl.

Figure 12:
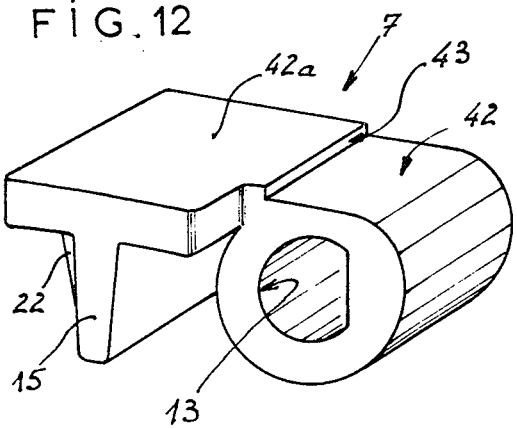
FIG. 12 is a perspective view of the pawl adapted to cooperate with the eye of FIG. 11.

As is also shown in these Figures and especially FIG. 12, the pawl 7 is provided at its back with another step 42 forming an abutment surface 43 which is transverse in orientation with the upper face 42*a* of the pawl.

These notches, steps and abutments are intended to cooperate with various parts of the movable tool 44 to facilitate the blocking and opening movements of the pawl as well as the insertion and removal of the cover within the ring 2.

Figure 13:
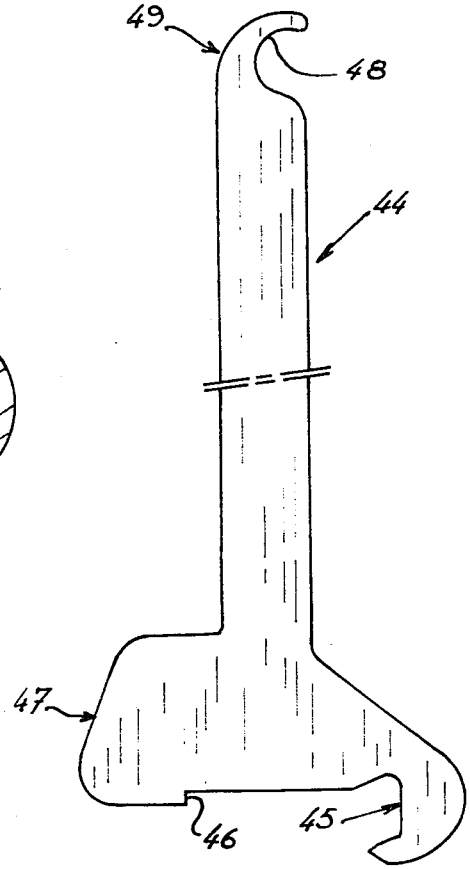
FIG. 13 is a side elevational view of a lever or tool used for opening the assembly of the other figures.

The tool or key 44 shown in FIG. 13 comprises at its lower end a part 45 in the form of a hook which is disposed opposite a catch 46. The part of the key carrying the catch is provided, at its back, with a cam profile 47. At its opposite end, the key 44 comprises another hook 48 whose back 49 is also rounded to form a cam.

To open the manhole cover using this tool, even when the pawl may be partly obstructed with pulverulent material, one simply inserts the hook 48 beneath the lower edge of the pawl 7 in the step 40 previously described (FIG. 14) and using the cam surface 49, rotates the tool in the direction of the arrow 52, i.e. in the clockwise sense, to lift the pawl upwardly.

When the pawl 7 has been lifted sufficiently to enable the hook 45 to engage around the free end of the pawl (FIG. 15), the key is reversed and the hook 45 engaged as shown in this Figure.

The catch 46 engages the transverse step 43 while the back 47 rests upon the wall 20 so that rotation of the lever 44 in the direction of the arrow 53, i.e. in the counterclockwise sense, will simultaneously continue to swing the pawl 7 upwardly and drive the pivot pin 8 and the cover 3 in the direction of the arrow 54, i.e. into a position in which lifting of the cover from the ring is possible via the flanges 15 forming the handles.

When the cover is again lowered in place, the tool 44 is again used as shown in FIG. 16, the hook 49 being inserted between the wall 28 and the finger 4 to drive the finger 4 in the direction of arrow 56 as the lever 44 is swung in the clockwise senser (arrow 55). These actions are possible in spite of the pressure of contaminants which might otherwise render the pawl difficult to lift or the finger 4 difficult to shift.

The pawl 7 is then dropped into place to resume the position shown in FIG. 14.

I claim:

1. A manhole cover assembly comprising:

a seating ring adapted to be received in a roadway pavement around a manhole opening, said ring being provided with at least one upwardly open lateral compartment communicating with the interior of said ring through a window formed in said ring and overhung by a beak defining a gap at said window;

a plug-type cover receivable in said ring and formed with a radially extending finger adapted to pass through said gap and to underlie said beak upon rotation of said cover relative to said ring; and locking means for preventing reverse rotation of said cover in said ring, said locking means including a horizontal pivot extending radially from said finger and adapted to be received in said compartment, and a pawl swingably mounted on said pivot for movement between an upright position allowing rotation of said cover in said ring and a horizontal position wherein a free end of said pawl is juxtaposed with a wall of said compartment to block rotation of said cover in said ring, said pivot and said pawl being provided with mutually engaging means preventing dislodgment of said pawl from said pivot.

2. The assembly defined in claim 1 wherein said end of said pawl is formed with a transverse flange adapted to form a handle enabling manipulation of said cover in an upright position of said pawl.

3. The assembly defined in claim 2 wherein said finger is formed with an inclined upper surface cooperating with a complementarily inclined lower surface of said beak to wedge said finger and said beak together upon rotation of said cover to shift said finger below said beak.

4. The assembly defined in claim 3 wherein said end of said pawl is formed with a wedge cooperating with a complementary surface of said wall of said compartment, said wedge tending to displace said cover to bring said finger beneath said beak upon swinging of said pawl from said upright position to said horizontal position.

5. The assembly defined in claim 1 wherein said end of said pawl defines with said wall a gap enabling insertion of a tool at said end of said pawl between said pawl and said ring to enable said pawl to be pried upwardly.

6. The assembly defined in claim 2 wherein the portion of said pawl provided with said flange is wider than the pivoted portion of said pawl by an amount corresponding substantially to the width of said beak, said pawl having a concave surface disposed proximal to a convex surface of said cover in said horizontal position of said pawl.

7. The assembly defined in claim 1, claim 2, claim 3, claim 4, claim 5 or claim 6 wherein said pin is formed with a groove and said pawl has a crescent-shaped formation received in said groove and enabling rotation of said pawl on said pin while retaining said pawl thereon.

8. The assembly defined in claim 1, claim 2, claim 3, claim 4, claim 5 or claim 6 wherein said pawl is formed with an outer surface provided with a groove enabling insertion of a pick between said pawl and said ring in an upright position of said pawl.

9. The assembly defined in claim 1, claim 2, claim 3, claim 4, claim 5 or claim 6, further comprising a lever formed with a hook at one end for prying said pawl upwardly from a horizontal position, said hook reaching beneath said pawl, and a formation at said other end engageable beneath said pawl and bearing thereon for rotating said pawl into an upright position while urging said cover relative to said ring in a direction tending to shift said finger from beneath said beak, each end of said lever being formed with a camming surface adapted to engage a portion of said ring.

* * * * *